US006588878B2

(12) United States Patent
Chou et al.

(10) Patent No.: US 6,588,878 B2
(45) Date of Patent: Jul. 8, 2003

(54) JET AND METHOD THEREOF FOR EJECTING DROPLETS OF DIFFERENT SIZES

(75) Inventors: Chung-Cheng Chou, Taipei (TW); Wei-Lin Chen, Taipei (TW); In-Yao Lee, Taipei Hsien (TW); Tsung-Ping Hsu, Tao-Yuan Hsien (TW); Hung-Sheng Hu, Kao-Hsiung (KR)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/063,750

(22) Filed: May 10, 2002

(65) Prior Publication Data

US 2002/0167564 A1 Nov. 14, 2002

(30) Foreign Application Priority Data

May 11, 2001 (TW) ..... 90111350 A

(51) Int. Cl.[7] ..... B41J 2/15
(52) U.S. Cl. ..... 347/40
(58) Field of Search ..... 347/40, 43, 20, 347/44, 61, 47, 27, 63, 54, 68–71, 75; 399/261; 310/328–330; 361/700; 29/890.1

(56) References Cited

U.S. PATENT DOCUMENTS 5,557,304 A 9/1996 Stortz
6,464,342 B1 * 10/2002 Kubota et al.

* cited by examiner

*Primary Examiner*—Raquel Yvette Gordon
(74) *Attorney, Agent, or Firm*—Winston Hsu

(57) ABSTRACT

A jet, and a method thereof, use bubbles as virtual valves to eject droplets of different sizes. The jet is in fluid communication with a reservoir and has a substrate, an orifice layer, first nozzles, and second nozzles. The substrate has a manifold for receiving ink from the reservoir. The orifice layer is positioned on the top of the substrate to form first chambers and second chambers. First orifices of the first nozzles and second orifices of the second nozzles are formed on the orifice layer. The jet has at least one of following characteristics: (a) the first chambers are larger than the second chambers; (b) an interval between two heating units of the first nozzle is larger than an interval between two heating units of the second nozzle; and (c) the apertures of the first orifices are larger than the apertures of the second orifices.

17 Claims, 13 Drawing Sheets

JET AND METHOD THEREOF FOR EJECTING DROPLETS OF DIFFERENT SIZES

BACKGROUND OF INVENTION

1. Field of the Invention

The present invention relates to a jet, and more particularly, to a jet that can eject droplets of different sizes.

2. Description of the Prior Art

Currently, jets ejecting droplets of different sizes are widely applied to improve combustion efficiency of fuel engines or increase a selectivity of ink jet printing. For example, ink jet printers can print documents with droplets of different sizes, and therefore improve a color variability and a speed of printing.

Please refer to FIG. 1 of a schematic diagram of a jet 10 according to the prior art. The jet 10 is disclosed in U.S. Pat. No. 4,251,824 "Liquid jet recording method with variable thermal viscosity modulation". The jet 10 uses a plurality of heat generating bodies 21~25 positioned on an axis of a chamber 12 to provide energy independently or in turn. Provision of energy causes a plurality of foams 31~35 to be generated in different positions, and therefore droplets of different sizes are ejected to print documents. However, since the plurality of heat generating bodies 21~25 must be disposed in one chamber 12 of the jet 10, the jet 10 must comprise more chambers 12 and heat generating bodies so as to improve the print quality. This gives rise to an increased difficulty in a fabricating process of the jet 10. In addition, the jet 10 has a disadvantage of easily jetting a satellite droplet, which leads to fuzziness in printed documents. The satellite droplets produced by the jet 10 follow the main droplets. When the jet 10 moves relative to the printed documents, the satellite droplets are printed onto places different from the main droplets. Thus, the print quality of the jet 10 is affected by the satellite droplets.

SUMMARY OF INVENTION

It is therefore a primary objective of the claimed invention to provide a jet which can eject droplets of different sizes to solve the above mentioned problem.

In a preferred embodiment, the claimed invention provides a jet, which uses a bubble as a virtual valve to increase flow resistance between a chamber and a manifold, or to interrupt flow communication between a chamber and a manifold. Then, another bubble is used to squeeze fluid inside the chamber and to eject the fluid out of the chamber. The jet comprises a substrate, an orifice layer, first nozzles and second nozzles. The orifice layer is positioned on the top layer of the substrate, and a plurality of first chambers and second chambers are formed between the orifice layer and the substrate.

It is an advantage of the claimed invention that the jet can eject droplets of different sizes by modifying sizes of the chambers and diameters of the orifices of the jet. Thus, the color variability and printing speed of the inkjet printer are improved.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
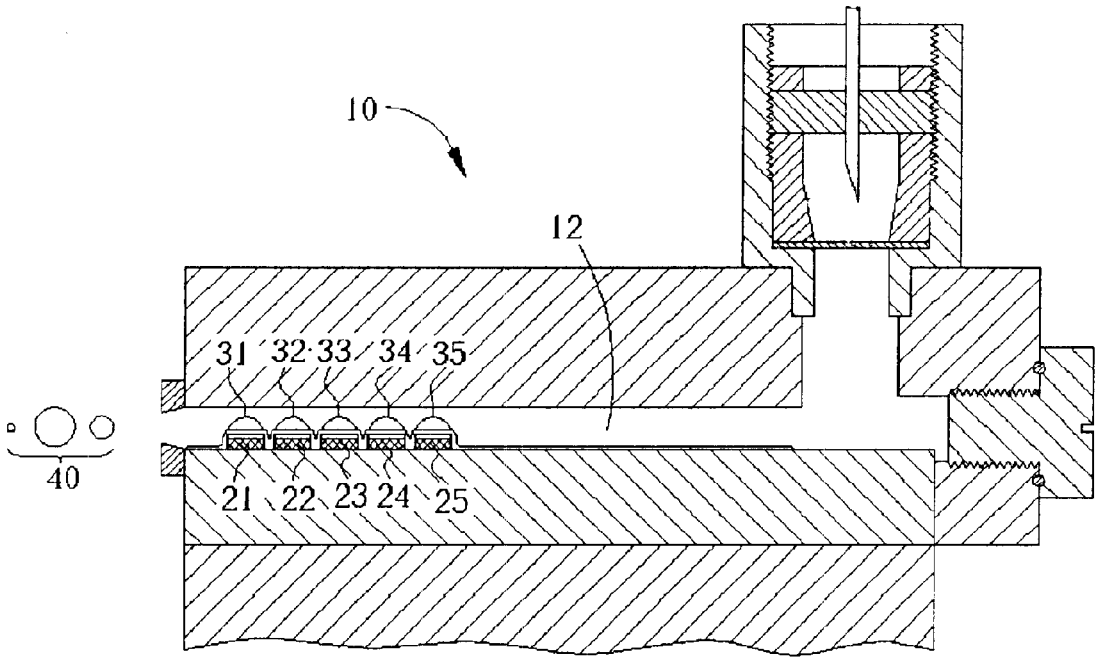
Fig. 1 Prior art
FIG. 1 is a schematic diagram of a jet according to the prior art.
Figure 2:
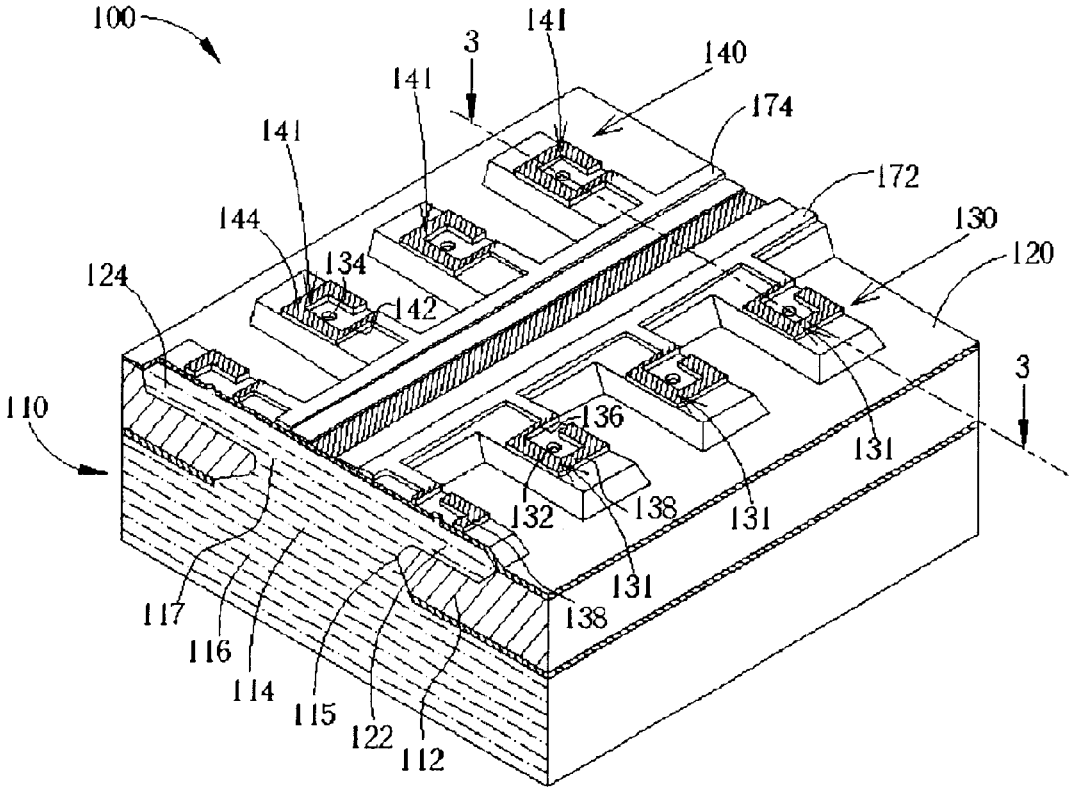
FIG. 2 is a schematic diagram of a jet according to a first embodiment of the present invention.

Please refer to FIG. 2 of a schematic diagram of a jet 100 according to a first embodiment of the present invention. The jet 100 in flow communication with a reservoir 110 comprises a substrate 112 positioned on one sideof the reservoir 110 and an orifice layer 120 disposed above the substrate 112. A plurality of first chambers 122 and a plurality of second chambers 124 are formed between the orifice layer 120 and the substrate. Volumes of the first chambers 122 are larger than volumes of the second chambers 124. The substrate 112 comprises a manifold 114 for receiving fluid from the reservoir 110 and transporting the fluid to the jet 100. The plurality of first chambers 122 are formed in a first side 115 of the manifold 114 and the plurality of second chambers 124 are formed in a second side 117 of the manifold 114. The orifice layer 120 comprises a first nozzle group 130 and a second nozzle group 140. The first nozzle group 130 comprises a plurality of first nozzles 131 and the second nozzle group 140 comprises a plurality of second nozzles 141. In addition, each first nozzle 131 corresponds to a first chamber 122 and each second nozzle 141 corresponds to a second chamber 124. Each first nozzle 131 comprises a first orifice 132, a first bubble generator 136 and a second bubble generator 138. Each second nozzle 141 comprises a second orifice 134, a third bubble generator 142 and a fourth bubble generator 144. The first orifice 132 is disposed on the orifice layer 120 and corresponds to the first chamber 122. The second orifice 134 is also disposed on the orifice layer 120 and corresponds to the second chamber 124. The first, second, third and fourth bubble generators 136, 138, 142, 144 are all heaters. The first heater 136 and the second heater 138 are used to heat fluid 116 inside the first chamber 122. The third heater 142 and the fourth heater 144 are used to heat fluid 116 inside the second chamber 124. Moreover, the first heater 136 and the second heater 138 are electrically connected to a first common electrode 172 in series. And, the third heater 142 and the fourth heater 144 are electrically connected to a second common electrode 174 in series.

Figure 3:
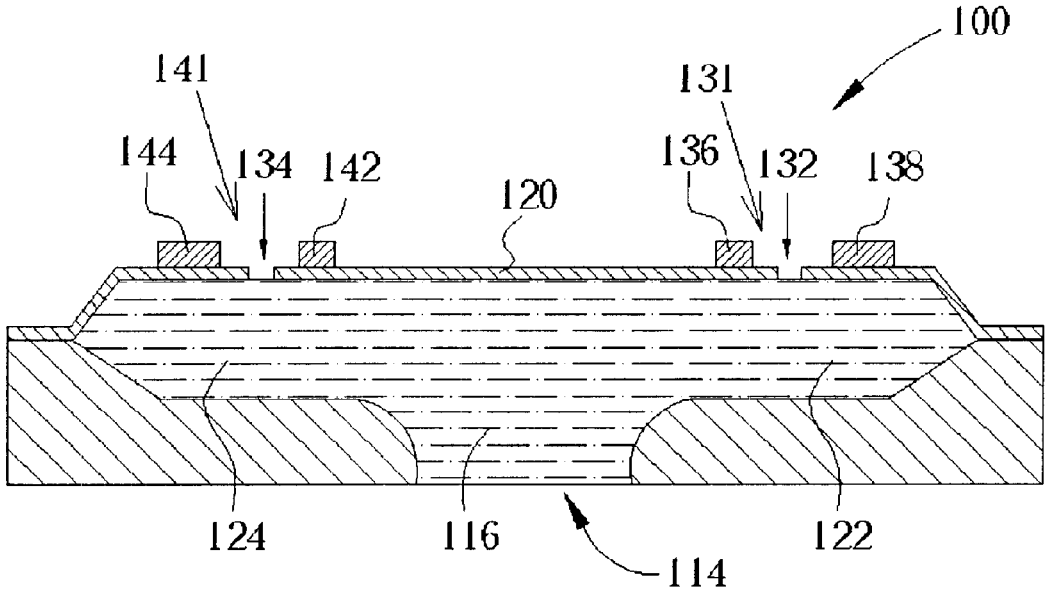
FIG. 3 is a section view along line 3—3 of the jet shown in FIG. 2.
Figure 4:
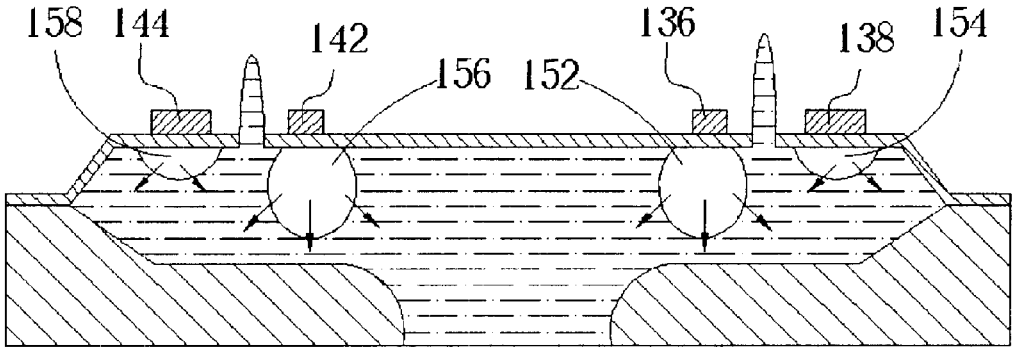
FIG. 4 is a cross-sectional diagram of the jet shown in FIG. 2 when bubbles are generated.
Figure 5:
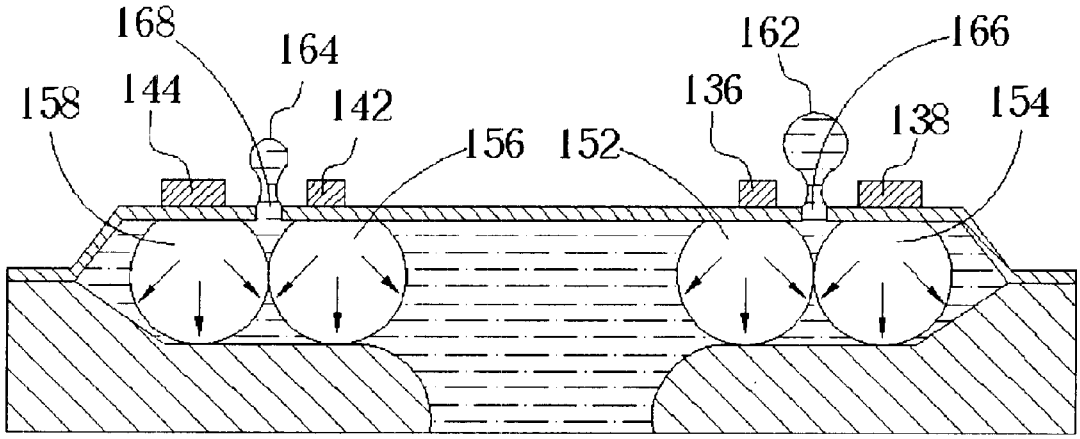
FIG. 5 is a cross-sectional diagram view of the jet shown in FIG. 2 when fluid is ejected.

Please refer to FIG. 3 to FIG. 5. FIG. 3 is a section view along line 3—3 of the jet 100 shown in FIG. 2. FIG. 4 is a cross-sectional diagram of the jet 100 shown in FIG. 2 when bubbles are generated. FIG. 5 is a cross-sectional diagram view of the jet 100 shown in FIG. 2 when fluid is ejected. As shown in FIG. 3 and FIG. 4, each first orifice 132 is disposed between the corresponding first heater 136 and the corresponding second heater 138. The first bubble heater 136 is closer to the manifold 114 than the second heater 138 is to the manifold 114. The first heater 136 heats the fluid 116 inside first chamber 122 to generate a first bubble 152. The second heater 138 heats the fluid 116 inside the first chamber 122 to generate a second bubble 154. In addition, each second orifice 134 is disposed between the corresponding third heater 142 and the corresponding fourth heater 144. The third bubble heater 142 is closer to the manifold 114 than the fourth heater 144 is to the manifold 114. The third heater 142 heats the fluid 116 inside second chamber 124 to generate a third bubble 156. The fourth heater 144 heats the fluid 116 inside second chamber 124 to generate a fourth bubble 158. Since the width of the first heater 136 is narrower than the width of the second heater 138, the resistance of the first heater 136 is larger. Therefore, the first bubble 152 is generated before the second bubble 154. In the same manner, the width of the third heater 142 is narrower than the width of the fourth heater 144, and the resistance of the third heater 136 is larger. Therefore, the third bubble 156 is generated before the fourth bubble 158. When the first bubble 152 is generated, it acts as a virtual valve for restricting the fluid 116 inside the first chamber 122 flowing to the manifold 114, and preventing the fluid 116 in the adjacent chambers from experiencing cross talk. When the third bubble 156 is generated, the fluid 116 inside the second chamber 124 flowing to the manifold 114 is also restricted and another virtual valve is formed to isolate the second chamber 125 from the manifold 114. After the first bubble 152 is generated, the second bubble 154 is generated by the second heater 138. At this time, the pressure of the fluid inside the first chamber 122 increases as the second bubble 154 expands. This leads to the fluid 116 inside the first chamber 122 being ejected from the first orifice 132 and then forming a first droplet 162. In like manner, after the third bubble 156 is generated, the fourth heater generates the fourth bubble 158. As the fourth bubble 158 expands, the fluid 116 inside the second chamber 124 experiences increased pressure and is ejected from the second orifice 134. This leads to formation of a second droplet 164. Please refer to FIG. 5. As the first bubble 152 and the second bubble 154 expand continuously, they approach each other gradually and then combine together. When the two bubbles combine, a tail 166 of the first droplet 162 is suddenly cut. Therefore, the first droplet 162 is ejected from the first nozzle 131. As a result, no or only few satellite droplet is formed after the first droplet 162 is ejected. In like manner, as the third bubble 156 and the fourth bubble 158 expand continuously, they approach each other gradually and then combine together. When the two bubbles combine, a tail 168 of the second droplet 164 is suddenly cut. Therefore, the second droplet 164 is ejected from the second nozzle 141. As a result, no or only few satellite droplet is formed after the second droplet 164 is ejected. In addition, the volume of the first chamber 122 is larger than that of the second chamber 124. Thus, the fluid volume between the first bubble 152 and the second bubble 154 is larger than the fluid volume between the third bubble 156 and the fourth bubble 158, leading to the first droplet 162 being larger than the second droplet 164.

Generally speaking, a method of ejecting a first droplet 162 and a second droplet 164 from the jet 100 comprises the following steps:(A) The first bubble 152 is generated in the corresponding first chamber 122 via the first bubble generator 136; (B) The second bubble 154 is generated in the corresponding first chamber 122 via the second bubble generator 138, after the first bubble 152 is generated, wherein the second bubble 154 squeezes fluid between the second bubble 154 and the corresponding first bubble 152 out of the corresponding first orifice 132 to form a first droplet 162;(C) The third bubble 156 is generated in the corresponding second chamber 124 via the third bubble generator 142; and(D) The fourth bubble 158 is generated in the corresponding second chamber 124 via the fourth bubble generator 158, after the third bubble 156 is generated, wherein the fourth bubble 158 squeezes fluid between the fourth bubble 158 and the corresponding third bubble 156 out of the corresponding second orifice 134 to form a second droplet 164.

In the steps mentioned above, the steps (A) and (B) are a process of generating the first droplet 162 and the steps (C) and (D) are a process of generating the second droplet 164. Except for a restriction of the step (B) being after the step (A) and the step (D) being after the step (C), there is no other limitation of order. For example, the method also works successfully in an order of (C)(D)(A)(B), (A)(C)(B)(D) or (A)(C)(D)(B). Based on this concept, and application thereof, many embodiments with different structures can be developed and shown as follows.

Figure 6:
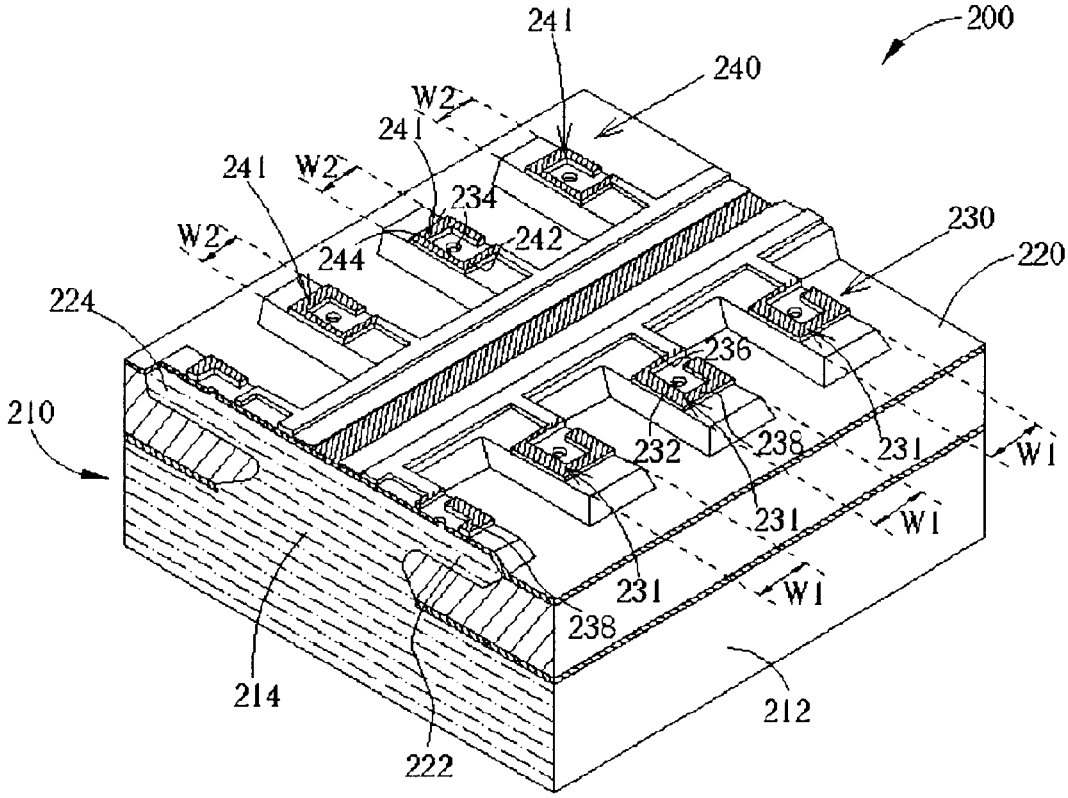
FIG. 6 is a cross-sectional diagram of a jet according to a second embodiment of the present invention.

Please refer to FIG. 6 of a schematic diagram of a jet 200 according to a second embodiment of the present invention. The jet 200 is similar in structure to the jet 100. The jet 200 in flow communication with a reservoir 210 comprises a substrate 212, an orifice layer 220, a first nozzle group 230, and a second nozzle group 240. The first nozzle group 230 comprises a plurality of first nozzles 231, and the second nozzle group 240 comprises a plurality of second nozzles 241. Each of first nozzles 231 comprises a first orifice 232, a first bubble generator 236, and a second bubble generator 238. Each of second nozzles 241 comprises a second orifice 234, a third bubble generator 242, and a fourth bubble generator 244. In the present embodiment, each of the four bubble generators 236, 238, 242 and 244 is a heater. In addition, a plurality of first chambers 222 and a plurality of second chambers 224 are formed between the orifice layer 220 and the substrate 212. The first chambers 222 and second chambers 224 are positioned on two sides of the manifold 214. The first orifice 232 is formed on the orifice layer 220 and corresponds to the first chamber 222, and the second orifice 234 is formed on the orifice layer 220 and corresponds to the second chamber 224. The jet 200 is different from the jet 100 in that the width W1 of the first chamber 222 is larger than the width W2 of the second chamber 224. When the first heater 236, the second heater 238, the third heater 242 and the fourth heater 244 heat fluid inside the first chamber 222 and the second chamber 224 and generate bubbles, because the width W1 of the first chamber 222 is larger than the width W2 of the second chamber 224, the bubbles in the first chamber 222 squeeze more fluid than that in the second chamber 224. Therefore, the first droplet ejected from the first orifice 232 is larger than the second droplet ejected from the second orifice 234. By squeezing different quantities of fluid, the jet 200 ejects droplets of different sizes.

Figure 7:
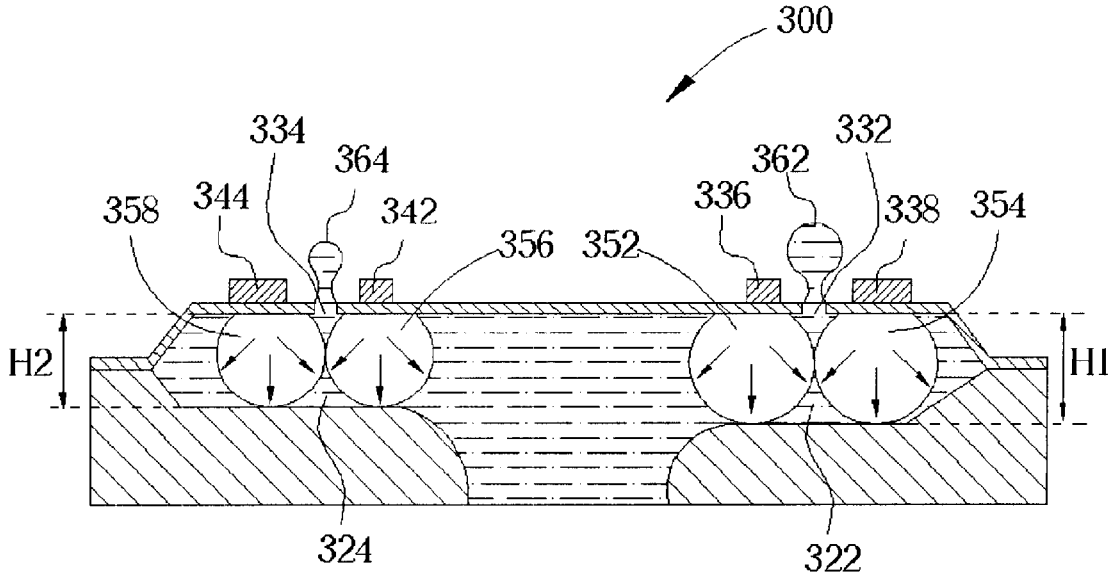
FIG. 7 is a cross-sectional diagram of a jet according to a third embodiment of the present invention.

Please refer to FIG. 7 of a schematic diagram of a jet 300 according to a third embodiment of the present invention. In the third embodiment, the jet 300 comprises a first chamber 322 and a second chamber 324 of different depths. A depth H1 of the first chamber 322 is larger than a depth H2 of the second chamber 324 as shown in FIG. 7. A first heater 336, a second heater 338, a third heater 342 and a fourth heater 344 heat fluid in the first chamber 322 and the second chamber 324 and generate a first bubble 352, a second bubble 354, a third bubble 356 and a fourth bubble 358. The size of the first droplet 362 ejected from a first orifice 332 is larger than the size of the second droplet 364 ejected from a second orifice 334, because the depth H1 of the first chamber 322 is larger than the depth H2 of the second chamber 324.

Figure 8:
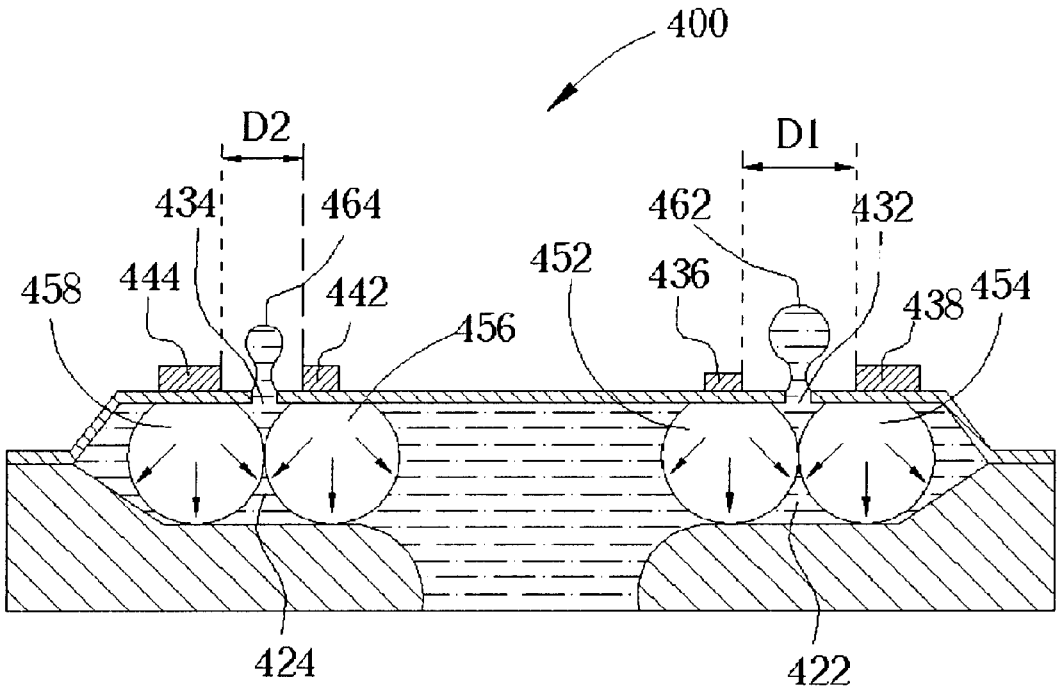
FIG. 8 is a cross-sectional diagram of a jet according to a fourth embodiment of the present invention.

Please refer to FIG. 8 of a schematic diagram of a jet 400 according to a fourth embodiment of the present invention. The interval D1 between a first heater 436 and a second heater 438 in different sides of a first orifice 432 is larger than the interval D2 between a third heater 442 and a fourth heater 444 in different sides of a second orifice 434. The first heater 436, the second heater 438, the third heater 442 and the fourth heater 444 heat fluid inside a first chamber 422 and a second chamber 424 and generate a first bubble 452, a second bubble 454, a third bubble 456, and a fourth bubble 458. Because the interval D1 between the first heater 436 and the second heater 438 in different sides of the first orifice 432 is larger than the interval D2 between the third heater 442 and the fourth heater 444 in different sides of the second orifice 434, a size of fluid in the first chamber 422 squeezed by the first bubble 452 and the second bubble 454 is larger than a size of fluid in the second chamber 424 squeezed by the third bubble 456 and the fourth bubble 458. This leads to a first droplet 462 ejected from the first orifice 432 being larger than a second droplet 464 ejected from the second orifice 434.

Figure 9:
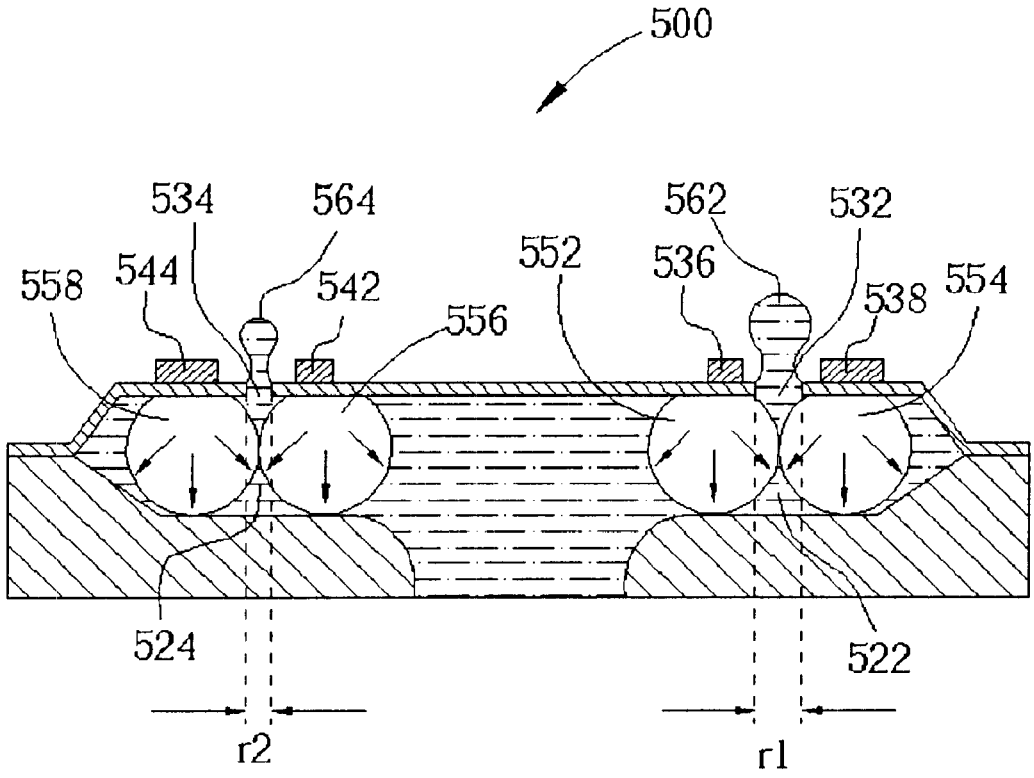
FIG. 9 is a cross-sectional diagram of a jet according to a fifth embodiment of the present invention.

Please refer to FIG. 9 of a schematic diagram of a jet 500 according to a fifth embodiment of the present invention. The diameter d1 of a first orifice 532 is larger than the diameter d2 of a second orifice 534. The first heater 536, the second heater 538, the third heater 542 and the fourth heater 544 heat fluid inside a first chamber 522 and a second chamber 524 and generate a first bubble 552, a second bubble 554, a third bubble 556, and a fourth bubble 558. Because the diameter d1 of the first orifice 532 is larger than the diameter d2 of the second orifice 534, a resistance of fluid in the first chamber 522 squeezed by the first bubble 552 and the second bubble 554 is smaller than a resistance of fluid in the second chamber 524 squeezed by the third bubble 556 and the fourth bubble 558. Therefore the first droplet 562 ejected from the first orifice 532 is larger than the second droplet 564 ejected from the second orifice 534.

Figure 10:
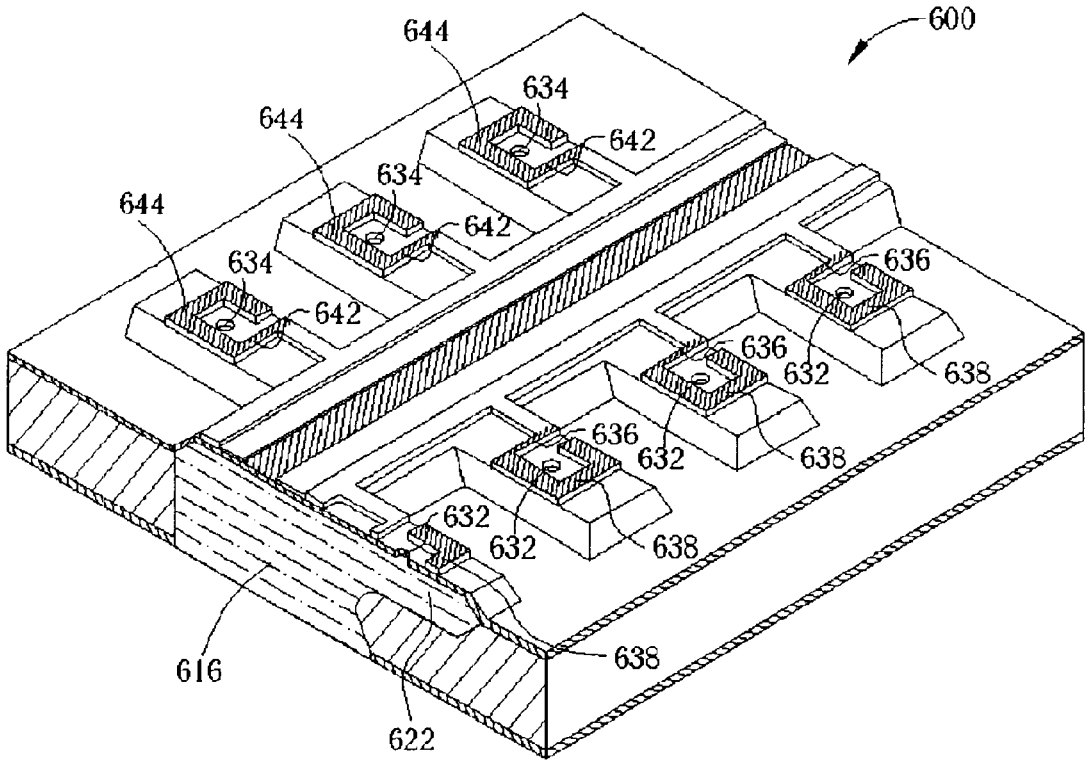
FIG. 10 and FIG. 11 are cross-sectional diagrams of jets according to a sixth embodiment of the present invention.
Figure 11:
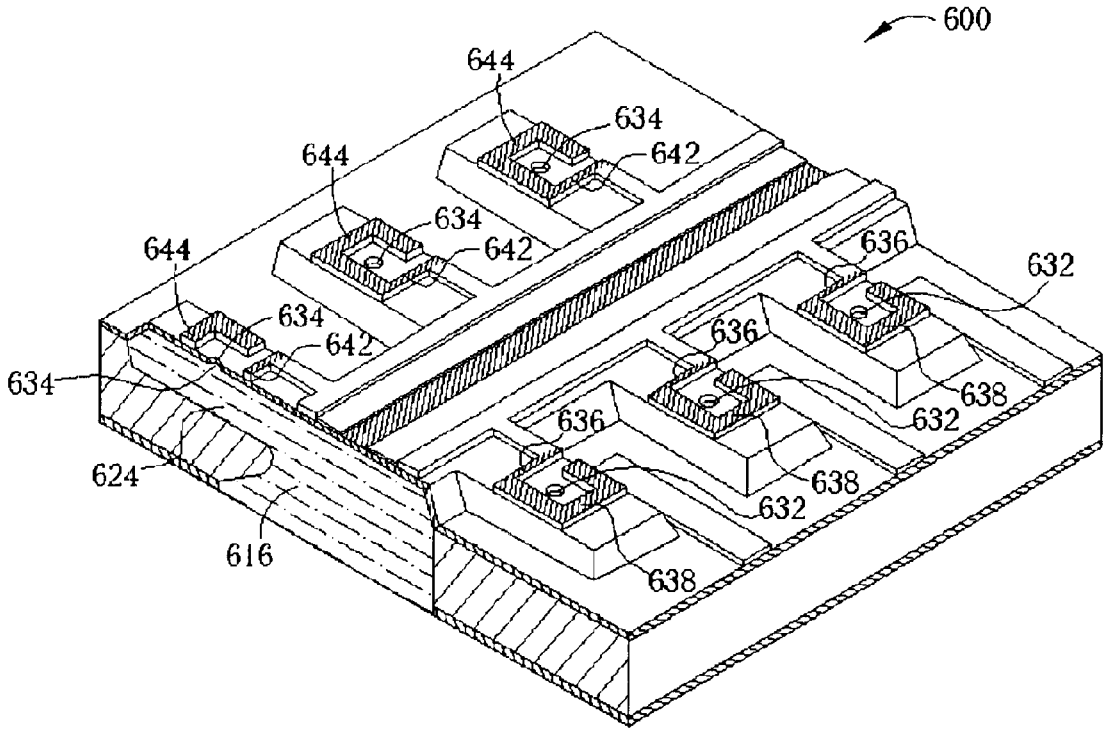

Please refer to FIG. 10 and FIG. 11 of schematic diagrams of a jet 600 according to a sixth embodiment of the present invention. The first and second chambers in the embodiments mentioned above are all disposed side by side. However, the present invention also works for chambers disposed in a stagger formation as shown in FIG. 10. When a first heater 636 and a second heater 638 of the jet 600 heat fluid inside a first chamber 622 and generate bubbles, an influence on fluid inside a second chamber 624 is less, therefore avoiding fluid inside the second chamber 624 being squeezed out of a second orifice 634. Likewise, bubbles generated in the second chamber 624 via the third heater 642 or the fourth heater 644 do not affect fluid inside the first chamber 622. In other words, the present embodiment reduces the cross talk between the first chamber 622 and the second chamber 624. It should be clear to one of ordinary skill in the art that other arrangements of the chambers are also appropriate in the present invention. For example, two or more kinds of chambers, which eject droplets of two or more different sizes, could be disposed in stagger, or other particular arrangements, on a same side of a manifold. Or, two or more kinds of chambers, which eject droplets of two or more different sizes, could be disposed in stagger, or other particular ways, on different sides of the manifold. The present invention can be applied to all jets that use two or more nozzle groups to eject droplets of different sizes by generating two bubbles in turn, respectively, and therefore reduce cross talk and satellite droplets without any restriction on the arrangement of the chambers.

Figure 12:
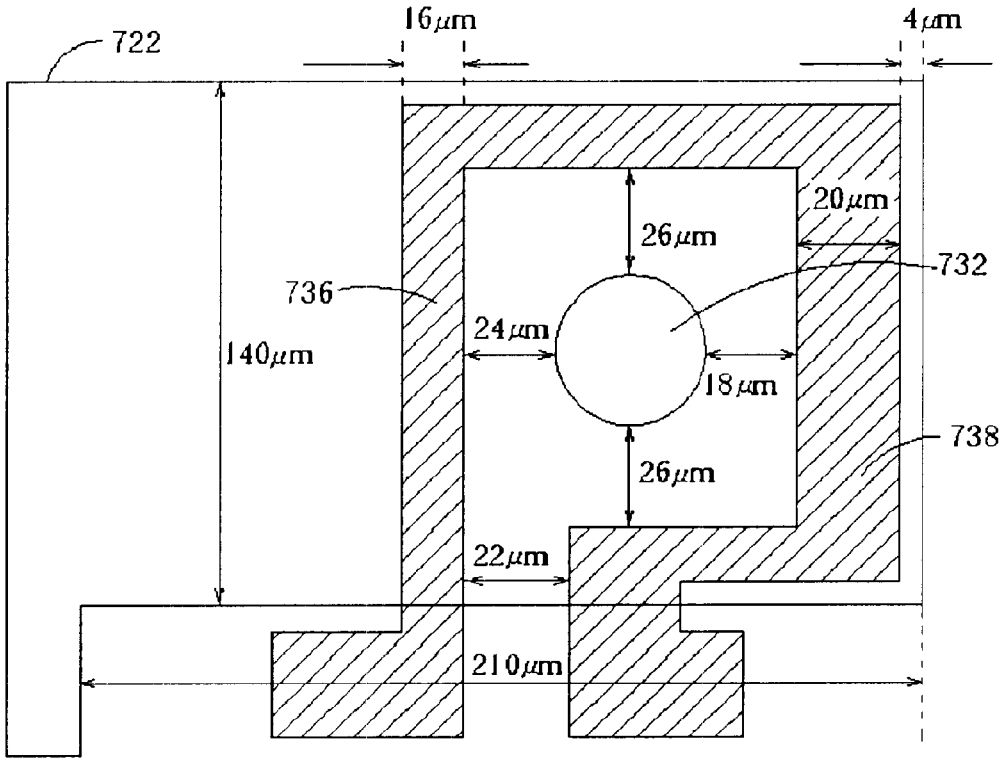
FIG. 12 and FIG. 13 are cross-sectional diagrams of a first chamber and a second chamber of a jet according to a seventh embodiment of the present invention.
Figure 13:
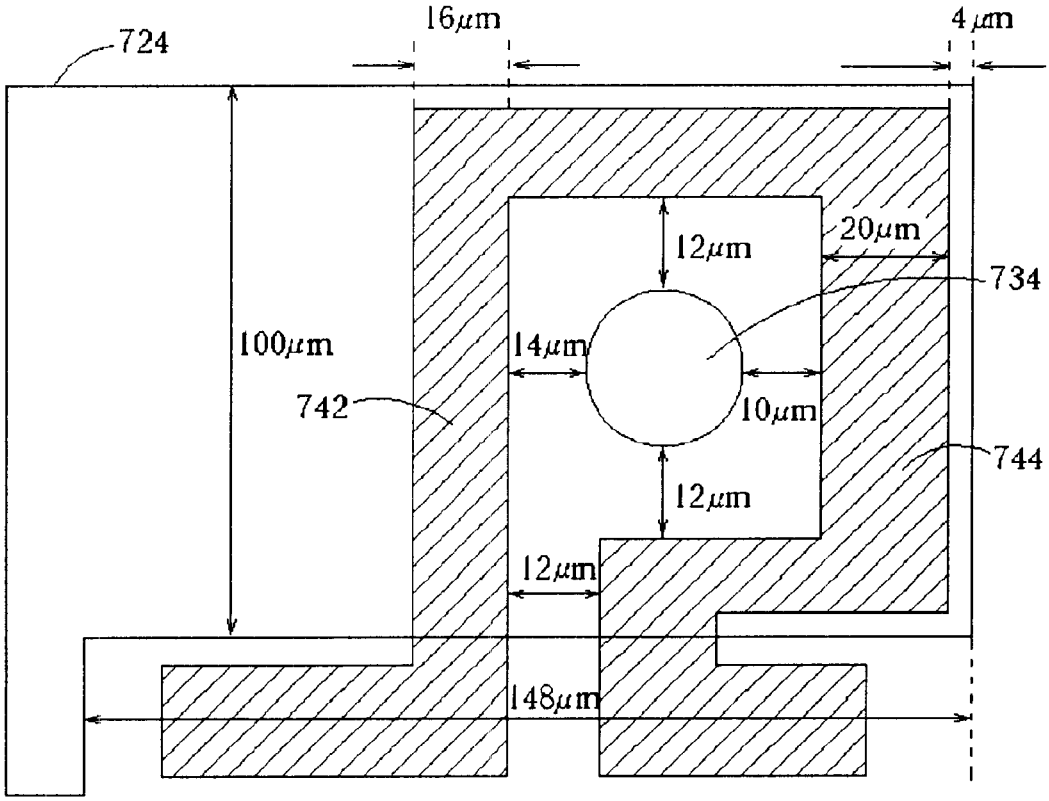

Please refer to FIGS. 12 and 13 of schematic diagrams of a first chamber 722 and a second chamber 724 according to a seventh embodiment of the present invention. FIG. 12 shows the first chamber 722, a first heater 736 and a second heater 738. FIG. 13 shows the second chamber 724, a third heater 742 and a fourth heater 744. When the first heater 736 and the second heater 738 heat fluid to generate bubbles, a droplet with a diameter of about 45 microns is ejected from a first orifice 732, and a droplet with a diameter of about 35 microns is ejected from a second orifice 734. Please note that the data of the droplet diameters is just shown for clearer illustration. In practice, the sizes of droplets ejected from the first orifice 732 and the second orifice 734 are affected by many conditions, such as the fluid properties, the environmental temperature, and/or the like. In the present embodiment, widths of the first chamber 722 and the second chamber 724 are different, and an interval between the first heater 736 and the second heater 738 is also larger than that between the third heater 742 and the fourth heater 744. As a result, droplets of different sizes are ejected from the first chamber 722 and the second chamber 724 based on this structure. It is obvious that different size parameters can be adjusted to design the first chamber 722 and the second chamber 724, and lead to droplets of different sizes.

In contrast to the prior art, the jet according to the present invention modifies structures of chambers, intervals between adjacent heaters, and diameters of orifices to eject droplets of different sizes. The present invention can be applied to color ink printers to improve color variation, and speed up printing. Moreover, the present invention can be applied to improve combustion efficiency of micro fuel engines, or applied to a field of biochemistry technology.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A jet in flow communication with a reservoir comprising:

a substrate having a manifold for receiving fluid from the reservoir;

an orifice layer disposed above the substrate, a plurality of first chambers and a plurality of second chambers being formed between the orifice layer and the substrate;

a first nozzle group comprising a plurality of first nozzles that are disposed on the orifice layer and correspond to the plurality of first chambers, each of the first nozzles comprising:

a first orifice;

a first bubble generator disposed at one side of the first orifice for generating a first bubble; and a second bubble generator disposed at another side of the first orifice for generating a second bubble which squeezes fluid between the first bubble and the second bubble out of the first orifice to form a first droplet; and a second nozzle group comprising a plurality of second nozzles that are disposed on the orifice layer and correspond to the plurality of second chambers, each of the second nozzles comprising:

a second orifice;

a third bubble generator disposed at one side of the second orifice for generating a third bubble; and a fourth bubble generator disposed at another side of the second orifice for generating a fourth bubble which squeezes fluid between the third bubble and the fourth bubble out of the second orifice to form a second droplet;

wherein structures of the first chambers are different from structures of the second chambers, so that sizes of the first droplets are different from sizes of the second droplets.

2. The jet of claim 1 wherein each of the bubble generators is a heater, the first heaters and the second heaters being used for heating fluid in the first chambers to generate the first and the second bubbles, the third heaters and the fourth heaters being used for heating fluid in the second chambers to generate the third and the fourth bubbles.

3. The jet of claim 2 wherein each of the first heaters connects in series with a corresponding second heater, and each of the third heaters connects in series with a corresponding fourth heater.

4. The jet of claim 1 wherein widths of the first chambers are different from widths of the second chambers, so that the sizes of the first droplets are different from the sizes of the second droplets.

5. The jet of claim 1 wherein depths of the first chambers are different from depths of the second chambers, so that the sizes of the first droplets are different from the sizes of the second droplets.

6. The jet of claim 1 wherein each of the first orifices is disposed between a corresponding first bubble generator and a corresponding second bubble generator wherein the first bubble generator is closer to the manifold than the second bubble generator, and each of the second orifices is disposed between a corresponding third bubble generator and a corresponding fourth bubble generator wherein the third bubble generator is closer to the manifold than the fourth bubble generator.

7. The jet of claim 1 wherein each of the first bubbles is used as a first virtual valve for restricting fluid in one of the first chambers to avoid flowing to the manifold when a corresponding second bubble is generated, and each of the third bubbles is used as a second virtual valve for restricting fluid in one of the second chambers to avoid flowing to the manifold when a corresponding fourth bubble is generated.

8. The jet of claim 1 wherein the substrate is disposed above the reservoir.

9. The jet of claim 1 wherein the first chambers and the second chambers are disposed in a stagger formation.

10. A jet in flow communication with a reservoir comprising:

a substrate having a manifold for receiving fluid from the reservoir;

an orifice layer disposed above the substrate, so that a plurality of first chambers and a plurality of second chambers are formed between the orifice layer and the substrate;

a first nozzle group comprising a plurality of first nozzles that are disposed on the orifice layer and correspond to the plurality of first chambers, each of the first nozzles comprising:

a first orifice;

a first bubble generator disposed at one side of the first orifice for generating a first bubble; and a second bubble generator disposed at another side of the first orifice for generating a second bubble which squeezes fluid between the first bubble and the second bubble out of the first orifice to form a first droplet; and a second nozzle group comprising a plurality of second nozzles that are disposed on the orifice layer and correspond to the plurality of second chambers, each of the second nozzles comprising:

a second orifice;

a third bubble generator disposed at one side of the second orifice for generating a third bubble; and a fourth bubble generator disposed at another side of the second orifice for generating a fourth bubble which squeezes fluid between the third bubble and the fourth bubble out of the second orifice to form a second droplet;

wherein intervals between the two bubble generators of the first nozzles are larger than intervals between the two bubble generators of the second nozzles, so that sizes of the first droplets are larger than sizes of the second droplets.

11. The jet of claim 10 wherein the first chambers and the second chambers are disposed in a stagger formation.

12. A jet in flow communication with a reservoir comprising:

a substrate having a manifold for receiving fluid from the reservoir;

an orifice layer disposed above the substrate so that a plurality of first chambers and a plurality of second chambers are formed between the orifice layer and the substrate;

a first nozzle group comprising a plurality of first nozzles that are disposed on the orifice layer and correspond to the plurality of first chambers, each of the first nozzles comprising:

a first orifice;

a first bubble generator disposed at one side of the first orifice for generating a first bubble; and a second bubble generator disposed at another side of the first orifice for generating a second bubble which squeezes fluid between the first bubble and the second bubble out of the first orifice to form a first droplet; and a second nozzle group comprising a plurality of second nozzles that are disposed on the orifice layer and correspond to the plurality of second chambers, each of the second nozzles comprising:

a second orifice;

a third bubble generator disposed at one side of the second orifice for generating a third bubble; and a fourth bubble generator disposed at another side of the second orifice for generating a fourth bubble which squeezes fluid between the third bubble and the fourth bubble out of the second orifice to form a second droplet;

wherein the first orifices are larger than the second orifices, so that sizes of the first droplets are larger than sizes of the second droplets.

13. A method for ejecting droplets of different sizes via a jet in flow communication with a reservoir, the jet comprising:

a substrate having a manifold for receiving fluid from the reservoir;

an orifice layer disposed above the substrate, and forming a plurality of first chambers and a plurality of second chambers between the orifice layer and the substrate, the first chambers being larger than the second chambers;

a first nozzle group comprising a plurality of first nozzles that are disposed on the orifice layer and correspond to the plurality of first chambers, each of the first nozzles comprising:

a first orifice;

a first bubble generator disposed at one side of the first orifice; and a second bubble generator disposed at another side of the first orifice; and a second nozzle group comprising a plurality of second nozzles that are disposed on the orifice layer and correspond to the plurality of second chambers, each of the second nozzles comprising:

a second orifice;

a third bubble generator disposed at one side of the second orifice; and a fourth bubble generator disposed at another side of the second orifice;

the method comprising:

generating first bubbles in corresponding first chambers via corresponding first bubble generators;

generating second bubbles in the corresponding first chambers via corresponding second bubble generators after the first bubbles are generated, wherein each of the second bubbles squeezes fluid between the second bubble and a corresponding first bubble out of a corresponding first orifice to form a first droplet;

generating third bubbles in corresponding second chambers via corresponding third bubble generators;

generating fourth bubbles in the corresponding second chambers via corresponding fourth bubble generators after the third bubbles are generated, wherein each of the fourth bubbles squeezes fluid between the fourth bubble and a corresponding third bubble out of a corresponding second orifice to form a second droplet which is smaller than the first droplet.

14. A method for ejecting droplets of different sizes via a jet in flow communication with a reservoir, the jet comprising:

a substrate having a manifold for receiving fluid from the reservoir;

an orifice layer disposed above the substrate, so that a plurality of first chambers and a plurality of second chambers are formed between the orifice layer and the substrate;

a first nozzle group comprising a plurality of first nozzles that are disposed on the orifice layer and correspond to the plurality of first chambers, each of the first nozzles comprising:

a first orifice;

a first bubble generator disposed at one side of the first orifice; and a second bubble generator disposed at another side of the first orifice; and a second nozzle group comprising a plurality of second nozzles that are disposed on the orifice layer and correspond to the plurality of second chambers, each of the second nozzles comprising:

a second orifice;

a third bubble generator disposed at one side of the second orifice; and a fourth bubble generator disposed at another side of the second orifice;

wherein intervals between two bubble generators of the first nozzles are larger than intervals between two bubble generators of the second nozzles;

the method comprising:

generating first bubbles in corresponding first chambers via corresponding first bubble generators;

generating second bubbles in the corresponding first chambers via corresponding second bubble generators after the first bubbles are generated, wherein each of the second bubbles squeezes fluid between the second bubble and a corresponding first bubble out of a corresponding first orifice to form a first droplet;

generating third bubbles in corresponding second chambers via corresponding third bubble generators;

generating fourth bubbles in the corresponding second chambers via corresponding fourth bubble generators after the third bubbles are generated, wherein each of the fourth bubbles squeezes fluid between the fourth bubble and a corresponding third bubble out of a corresponding second orifice to form a second droplet which is smaller than the first droplet.

15. A method for ejecting droplets of different sizes via a jet in flow communication with a reservoir, the jet comprising:

a substrate having a manifold for receiving fluid from the reservoir;

an orifice layer disposed above the substrate so that a plurality of first chambers and a plurality of second chambers are formed between the orifice layer and the substrate;

a first nozzle group comprising a plurality of first nozzles that are disposed on the orifice layer and correspond to the plurality of first chambers, each of the first nozzles comprising:

a first orifice;

a first bubble generator disposed at one side of the first orifice; and a second bubble generator disposed at another side of the first orifice; and a second nozzle group comprising a plurality of second nozzles that are disposed on the orifice layer and correspond to the plurality of second chambers, each of the second nozzles comprising:

a second orifice;

a third bubble generator disposed at one side of the second orifice; and a fourth bubble generator disposed at another side of the second orifice;

wherein the first orifices are larger than the second orifices;

the method comprising:

generating first bubbles in corresponding first chambers via corresponding first bubble generators;

generating second bubbles in the corresponding first chambers via corresponding second bubble generators after the first bubbles are generated, wherein each of the second bubbles squeezes fluid between the second bubble and a corresponding first bubble out of a corresponding first orifice to form a first droplet;

generating third bubbles in corresponding second chambers via corresponding third bubble generators;

generating fourth bubbles in the corresponding second chambers via corresponding fourth bubble generators after the third bubbles are generated, wherein each of the fourth bubbles squeezes fluid between the fourth bubble and a corresponding third bubble out of a corresponding second orifice to form a second droplet which is smaller than the first droplet.

16. A jet in flow communication with a reservoir comprising:

a substrate having a manifold for receiving fluid from the reservoir;

an orifice layer disposed above the substrate so that a first chamber and a second chamber are formed between the orifice layer and the substrate;

a first nozzle disposed on the orifice layer comprising a first orifice, a first bubble generator, and a second bubble generator, wherein the first bubble generator and the second bubble generator are disposed at two sides of the first orifice, the first bubble generator is capable of generating a first bubble which is used as a first virtual valve for restricting fluid in the first chamber to avoid flowing to the manifold, and the second bubble generator is capable of generating a second bubble for squeezing fluid between the first bubble and the second bubble out of the first orifice so as to form a first droplet; and a second nozzle disposed on the orifice layer comprising a second orifice, a third bubble generator, and a fourth bubble generator, wherein the third bubble generator and the fourth bubble generator are disposed at two sides of the second orifice, the third bubble generator is capable of generating a third bubble which is used as a second virtual valve for restricting fluid in the second chamber to avoid flowing to the manifold, and the fourth bubble generator is capable of generating a fourth bubble for squeezing fluid between the third bubble and the fourth bubble out of the second orifice so as to form a second droplet;

wherein a size of the first droplet is larger than a size of the second droplet.

17. A method for ejecting droplets of different sizes via a jet in flow communication with a reservoir, the jet comprising:

a substrate having a manifold for receiving fluid from the reservoir;

an orifice layer disposed above the substrate so that a first chamber and a second chamber are formed between the orifice layer and the substrate, structure of the first chamber is different from structure of the second chamber;

a first nozzle having a first orifice, a first bubble generator, and a second bubble generator, wherein the first bubble generator and the second bubble generator are disposed at two sides of the first orifice; and a second nozzle having a second orifice, a third bubble generator, and a fourth bubble generator, wherein the third bubble generator and the fourth bubble generator are disposed at two sides of the second orifice;

the method comprising:

generating a first bubble in the first chamber via the first bubble generator and generating a second bubble in the first chamber via the second bubble generator, wherein the first bubble and the second bubble approach each other, so that fluid between the first bubble and the second bubble is squeezed out of the first orifice to form a first droplet;

generating a third bubble in the second chamber via the third bubble generator and generating a fourth bubble in the second chamber via the fourth bubble generator, wherein the third bubble and the fourth bubble approach each other, so that fluid between the third bubble and the fourth bubble is squeezed out of the second orifice to form a second droplet which is smaller than the first droplet.

* * * * *